US009771628B2

(12) United States Patent
Motoya et al.

(10) Patent No.: US 9,771,628 B2
(45) Date of Patent: Sep. 26, 2017

(54) DUPLEX STAINLESS STEEL AND PRODUCTION METHOD THEREFOR

(75) Inventors: Daisuke Motoya, Tokyo (JP); Masahiko Hamada, Tokyo (JP); Hisashi Amaya, Tokyo (JP); Hiroyuki Nagayama, Tokyo (JP); Kenta Yamada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 117 days.

(21) Appl. No.: 13/984,314

(22) PCT Filed: Feb. 10, 2012

(86) PCT No.: PCT/JP2012/053036
§ 371 (c)(1),
(2), (4) Date: Aug. 8, 2013

(87) PCT Pub. No.: WO2012/111536
PCT Pub. Date: Aug. 23, 2012

(65) Prior Publication Data

US 2013/0312880 A1 Nov. 28, 2013

(30) Foreign Application Priority Data

Feb. 14, 2011 (JP) ..... 2011-028335

(51) Int. Cl.
*C22C 38/58* (2006.01)
*C21D 6/00* (2006.01)
(Continued)

(52) U.S. Cl.
CPC ..... *C21D 6/005* (2013.01); *C21D 6/004* (2013.01); *C21D 6/008* (2013.01); *C22C 1/02* (2013.01);
(Continued)

(58) Field of Classification Search
USPC ..... 148/607
See application file for complete search history.

(56) References Cited

U.S. PATENT DOCUMENTS 8,778,260 B2 * 7/2014 Tsuge ..... C21C 5/005 420/38
2009/0098007 A1 * 4/2009 Tsuge ..... C21C 5/005 420/38
(Continued)

FOREIGN PATENT DOCUMENTS

JP 63-317204 12/1988
JP 06-184699 7/1994
(Continued)

OTHER PUBLICATIONS

Machine translation of JP1996-120413A. May 1996.*
(Continued)

*Primary Examiner* — Xiaowei Su
(74) *Attorney, Agent, or Firm* — Clark & Brody

(57) ABSTRACT

Provided is a duplex stainless steel having a high strength and a high toughness. A stainless steel according to the present invention includes: a chemical composition containing, in mass percent, C: at most 0.030%, Si: 0.20 to 1.00%, Mn: at most 8.00%, P: at most 0.040%, S: at most 0.0100%, Cu: more than 2.00% and at most 4.00%, Ni: 4.00 to 8.00%, Cr: 20.0 to 30.0%, Mo: at least 0.50% and less than 2.00%, N: 0.100 to 0.350%, and sol. Al: at most 0.040%, the balance being Fe and impurities; and a structure, wherein a rate of ferrite in the structure is 30 to 70%, and a hardness of the ferrite in the structure is at least 300 $Hv_{10gf}$.

9 Claims, 2 Drawing Sheets

(51) Int. Cl.

| | |
|---|---|
| ***C22C 38/54*** | (2006.01) |
| ***C22C 38/46*** | (2006.01) |
| ***C22C 38/00*** | (2006.01) |
| ***C22C 38/42*** | (2006.01) |
| ***C22C 38/04*** | (2006.01) |
| ***C22C 38/02*** | (2006.01) |
| ***C22C 38/44*** | (2006.01) |
| ***C22C 38/06*** | (2006.01) |
| ***C22C 1/02*** | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/54* (2013.01); *C22C 38/58* (2013.01); *C21D 2211/005* (2013.01)

(56) References Cited

U.S. PATENT DOCUMENTS

2012/0177529 A1* 7/2012 Amaya et al. ..... 420/40
2013/0315776 A1* 11/2013 Yamada et al. ..... 420/40

FOREIGN PATENT DOCUMENTS

| | | | |
|---|---|---|---|
| JP | 07-268552 | | 10/1995 |
| JP | 08-120413 | | 5/1996 |
| JP | 08-170153 | | 7/1996 |
| JP | 06-145903 | | 5/1997 |
| JP | 2726591 | | 12/1997 |
| JP | 10-60526 | | 3/1998 |
| JP | 10-60598 | | 3/1998 |
| JP | 2000313940 A | * | 11/2000 |
| JP | 2001-220652 | | 8/2001 |
| JP | 2002-241838 | | 8/2002 |
| JP | 2002-339042 | | 11/2002 |

OTHER PUBLICATIONS

Machine translation of JP 2000313940 A, Nov. 2000.*
Machine translation of JP2002-339042A. Nov. 2002.*
Topolska et al. (Journal of Achievements in Materials and Manufacturing Engineering, 2009, vol. 36, p. 142-149).*

* cited by examiner

DUPLEX STAINLESS STEEL AND PRODUCTION METHOD THEREFOR

TECHNICAL FIELD

The present invention relates to a duplex stainless steel and a production method therefor, and, more particularly, to a duplex stainless steel that is suitable for a steel material for a line pipe and a production method therefor.

BACKGROUND ART

Petroleum oil and natural gas produced from oil fields and gas fields contain associated gas. The associated gas contains corrosive gas such as carbon dioxide gas ($CO_2$) and hydrogen sulfide ($H_2S$). Line pipes transport the associated gas while transmitting the petroleum oil and the natural gas. Hence, the line pipes suffer from problems of stress corrosion cracking (SCC), sulfide stress corrosion cracking (sulfide stress cracking: SSC), and general corrosion cracking that causes a decrease in wall thickness. Accordingly, stainless steel for the line pipes is required to have an excellent corrosion resistance. Duplex stainless steel has an excellent corrosion resistance. Hence, the duplex stainless steel is used for the line pipes.

The duplex stainless steel for the line pipes is further required to have an excellent yield strength and toughness, in addition to the above-mentioned corrosion resistance. Techniques intended to improve the strength and toughness of duplex stainless steel are disclosed in JP 10-60598A, JP 10-60526A, JP 7-268552A, JP 6-184699A, JP 6-145903A, JP 2726591B, and JP 3155431B.

The duplex stainless steel disclosed in JP 10-60598A and JP 10-60526A contains 2 to 6% of Mo and 4 to 10% of W, and further contains 1 to 4% of Cu. JP 10-60598A and JP 10-60526A describe that aging heat treatment performed on the duplex stainless steel for 4 hours at 480° C. can provide the duplex stainless steel with an excellent strength.

The duplex stainless cast steel disclosed in JP 7-268552A contains 0.1 to 2% of C and 2% or less of Cu. JP 7-268552A describes that precipitation hardening heat treatment performed on the duplex stainless cast steel at 600 to 700° C. can provide the duplex stainless cast steel with a high strength.

The duplex stainless steel disclosed in JP 6-184699A is made of a casting material. The duplex stainless steel contains 0.5 to 4% of Cu and 0.5 to 3% of W. Precipitation hardening heat treatment performed on the duplex stainless steel at 600 to 700° C. can cause fine Nb carbo-nitrides and V carbo-nitrides to disperse therein. JP 6-184699A describes that this can provide the duplex stainless steel with a high strength.

The duplex stainless steel disclosed in JP 6-145903A is made of a casting material. The duplex stainless steel contains 0.5 to 4% of Cu, 0.5 to 3% of W, and 0.1 to 0.5% of Ta. Cu and W are dissolved in ferrite, and strengthen the ferrite. Ta forms carbides, finely disperses in ferrite, and increases the strength thereof. JP 6-145903A describes that the duplex stainless steel can thus be provided with an excellent corrosion fatigue strength.

The duplex stainless steel disclosed in JP 2726591B contains 1 to 4% of Cu and 2% or less of W. Precipitation strengthening treatment performed on the duplex stainless steel at 600 to 700° C. can cause Cu to be precipitated for precipitation strengthening. JP 2726591B describes that the duplex stainless steel can thus be provided with an excellent strength.

The duplex stainless cast member disclosed in JP 3155431B contains 2.6 to 3.5% of Cu, and aging heat treatment is performed thereon for 4 hours at 480° C. JP 3155431B describes that the strength of the steel is improved by precipitation strengthening of Cu.

DISCLOSURE OF THE INVENTION

Unfortunately, the duplex stainless steel disclosed in each of the above-mentioned patent documents may not be provided with both of an excellent strength and an excellent toughness at the same time. Specifically, in JP 10-60598A and JP 10-60526A, an excellent strength may not be obtained. Moreover, in JP 10-60598A and JP 10-60526A, an excellent toughness may not be obtained due to excessive precipitation of carbides. In JP 7-268552A, JP 6-184699A, and JP 2726591B, an excellent strength and toughness may not be obtained. In JP 6-145903A, Ta may form coarse carbides, and an excellent toughness may not be obtained. In JP 3155431B, an excellent strength may not be obtained.

The present invention has an objective to provide a duplex stainless steel having a high strength and a high toughness.

A stainless steel according to the present invention includes: a chemical composition containing, in mass percent, C: at most 0.030%, Si: 0.20 to 1.00%, Mn: at most 8.00%, P: at most 0.040%, S: at most 0.0100%, Cu: more than 2.00% and at most 4.00%, Ni: 4.00 to 8.00%, Cr: 20.0 to 30.0%, Mo: at least 0.50% and less than 2.00%, N: 0.100 to 0.350%, and sol. Al: at most 0.040%, the balance being Fe and impurities; and a structure, wherein a rate of ferrite in the structure is 30 to 70%, and a hardness of the ferrite in the structure is at least 300 $Hv_{10gf}$.

The duplex stainless steel according to the present invention has a high strength and a high toughness.

The chemical composition of the above-mentioned duplex stainless steel may contain one or more types of element selected from at least one group of the following first group to third group, instead of part of the Fe.

First group: V: 1.50% or less

Second group: Ca: 0.0200% or less, Mg: 0.02% or less, and B: 0.0200% or less

Third group: rare earth metal (REM): 0.2000% or less

Preferably, the duplex stainless steel according to the present invention is subjected to solution treatment at 980 to 1,200° C., and is further subjected to aging heat treatment at 460 to 630° C.

A production method for a duplex stainless steel material according to the present invention includes the steps of: producing a duplex stainless steel material having a chemical composition containing, in mass percent, C: at most 0.030%, Si: 0.20 to 1.00%, Mn: at most 8.00%, P: at most 0.040%, S: at most 0.0100%, Cu: more than 2.00% and at most 4.00%, Ni: 4.00 to 8.00%, Cr: 20.0 to 30.0%, Mo: at least 0.50% and less than 2.00%, N, 0.100 to 0.350%, and sol. Al: at most 0.040%, the balance being Fe and impurities; performing solution treatment on the produced duplex stainless steel material at 980 to 1,200° C.; and performing aging heat treatment on the duplex stainless steel material that has been subjected to the solution treatment, at 460 to 630° C.

DESCRIPTION OF EMBODIMENTS

Hereinafter, an embodiment of the present invention is described in detail with reference to the drawings. Hereinafter, "%" in the content of an element means mass percent.

The inventors of the present invention carried out various experiments and detailed studies to obtain the following findings.

(a) Solution treatment is performed on a duplex stainless steel having a chemical composition at an appropriate temperature, and aging heat treatment is then performed thereon at an appropriate temperature. The chemical composition contains, in mass percent, C: at most 0.030%, Si: 0.20 to 1.00%, Mn: at most 8.00%, P: at most 0.040%, S: at most 0.0100%, Cu: more than 2.00% and at most 4.00%, Ni: 4.00 to 8.00%, Cr: 20.0 to 30.0%, Mo: at least 0.50% and less than 2.00%, N, 0.100 to 0.350%, and sol. Al: at most 0.040%, and the balance being Fe and impurities. Consequently, a large amount of fine Cu precipitates in ferrite, and the strength of the duplex stainless steel increases.

Figure 1A:
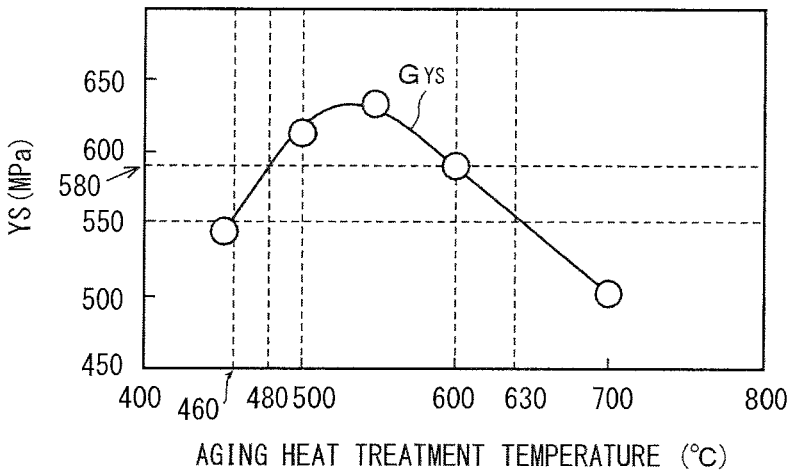
FIG. 1A is a graph showing a relation between an aging heat treatment temperature and the yield strength of a duplex stainless steel.

(b) FIG. 1A is a graph showing a relation between an aging heat treatment temperature (° C.) and the yield strength (MPa) of the duplex stainless steel. FIG. 1A was obtained according to the following method.

A duplex stainless steel having the same chemical composition as that of steel A in Table 1 to be described later was molten. The molten duplex stainless steel was cast, whereby ingots were produced. The produced ingots were each heated to 1,250° C. Hot forging was performed on the heated ingots, whereby plate materials were produced. The produced plate materials were heated again to 1,250° C. Hot rolling was performed on the heated plate materials, whereby a plurality of steel plates were produced. The surface temperature of each steel material at the time of the rolling was 1,050° C.

Solution treatment was performed on the plurality of produced steel plates at 1,070° C. At this time, the soaking time was 5 minutes. After the solution treatment, aging heat treatment was performed on the plurality of steel plates at various aging heat treatment temperatures. The soaking time of the aging heat treatment was 30 minutes. The yield strength (MPa) of each steel plate that was subjected to the aging heat treatment was measured. At this time, an offset yield stress of 0.2% based on ASTM A370 was defined as the yield strength (MPa). FIG. 1A was made on the basis of the obtained yield strength.

With reference to FIG. 1A, a graph $G_{YS}$ of the yield strength of the duplex stainless steel is convex upward and has a peak in the vicinity of an aging heat treatment temperature of 550° C. More specifically, until the aging heat treatment temperature reaches 550° C., the yield strength increases as the aging heat treatment temperature increases. Meanwhile, after the aging heat treatment temperature exceeds 550° C., the yield strength decreases as the aging heat treatment temperature increases. As shown in FIG. 1A, in the case where the aging heat treatment temperature is 460 to 630° C., the yield strength of the duplex stainless steel is equal to or more than 550 MPa. Moreover, in the case where the aging heat treatment temperature is 480 to 600° C., the yield strength of the duplex stainless steel is equal to or more than 580 MPa.

Figure 1B:
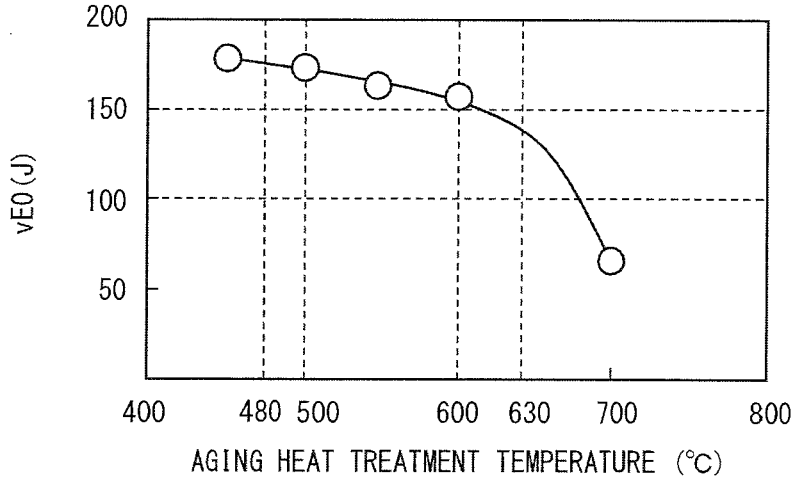
FIG. 1B is a graph showing a relation between the aging heat treatment temperature and the toughness of the duplex stainless steel.

(C) FIG. 1B is a graph showing a relation between the aging heat treatment temperature and absorbed energy (vE0) of the duplex stainless steel obtained in a Charpy impact test at 0° C. FIG. 1B was obtained according to the following method. A full-size V-notch specimen (having a width of 10 mm, a thickness of 10 mm, a length of 55 mm, and a notch depth of 2 mm) was collected from each steel plate produced at the time of making FIG. 1A. The Charpy impact test at 0° C. was performed using the collected V-notch specimen on the basis of JIS 22242, whereby the absorbed energy (vE0) was obtained.

With reference to FIG. 1B, in the case where the aging heat treatment temperature is equal to or less than 630° C., the absorbed energy vE0 of the duplex stainless steel gradually decreases with the aging heat treatment temperature. Then, after the aging heat treatment temperature exceeds 630° C., the toughness of the duplex stainless steel rapidly decreases as the aging heat treatment temperature increases. That is, the absorbed energy vE0 has an inflection point in the vicinity of an aging heat treatment temperature of 630° C. Then, when the aging heat treatment temperature is equal to or less than 630° C., the absorbed energy vE0 is as high as 100 J or more. Moreover, in the case where the aging heat treatment temperature is equal to or less than 600° C., the absorbed energy vE0 of the duplex stainless steel is equal to or more than 150 J.

Figure 2:
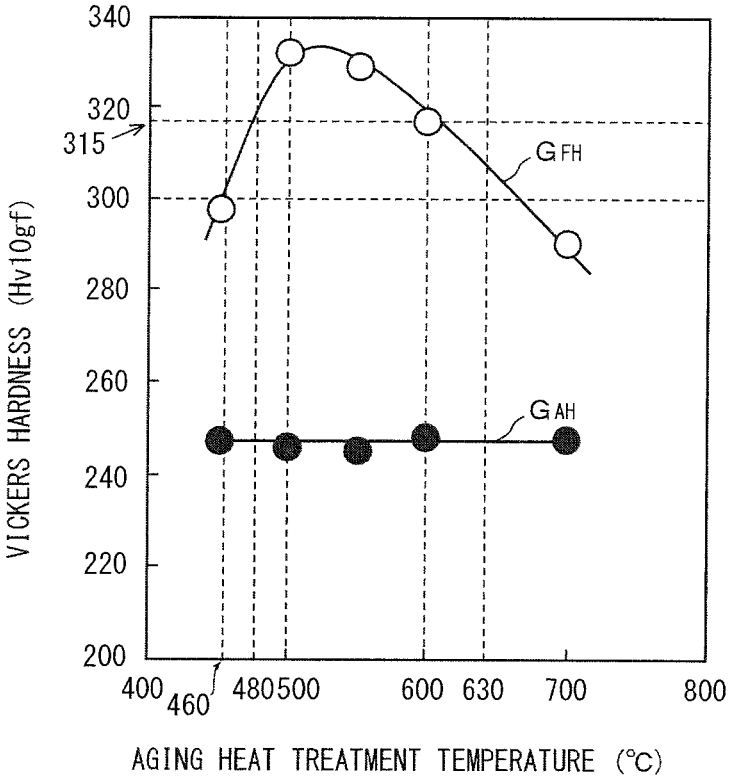
FIG. 2 is a graph showing a relation between the aging heat treatment temperature and each of the ferrite hardness and the austenite hardness in the duplex stainless steel.

(d) FIG. 2 is a graph showing a relation between the aging heat treatment temperature and the Vickers hardness ($Hv_{10gf}$) of each of a ferrite phase and an austenite phase in the duplex stainless. FIG. 2 was obtained according to the following method.

A sample for structure observation was collected from each steel plate produced at the time of making FIG. 1A. The collected sample was mechanically polished, and then the polished sample was electrolytically etched in a 30%-KOH solution. The etched sample surface was observed using an optical microscope, and a ferrite phase and an austenite phase thereof were found. Given ten points were selected from the found ferrite phase. The Vickers hardness in conformity to JIS 22244 was measured at the selected ten points. The test power at the time of the measurement was set to 98.07 N (the hardness symbol was "$Hv_{10gf}$"). The average of eight points obtained by excluding the maximum value and the minimum value from the measured Vickers hardness values was defined as the hardness of the ferrite. Similarly, given ten points were selected from the found austenite phase. Similarly to the ferrite phase, the Vickers hardness was measured at the selected ten points. The average of eight points obtained by excluding the maximum value and the minimum value from the measured Vickers hardness values was defined as the hardness of the austenite.

With reference to FIG. 2, a graph $G_{FH}$ of the hardness of the ferrite phase has the same shape as that of the yield strength of the duplex stainless steel shown in FIG. 1A. Specifically, the curved line $G_{FH}$ is convex upward and has a peak in the vicinity of an aging heat treatment temperature of 550° C. Then, in the case where the aging heat treatment temperature is 460 to 630° C., the hardness of the ferrite phase is equal to or more than 300 $Hv_{10gf}$. Moreover, in the case where the aging heat treatment temperature is 480 to 600° C., the hardness of the ferrite phase is equal to or more than 315 $Hv_{10gf}$. Meanwhile, in a graph $G_{AH}$ showing the hardness of the austenite phase, even if the aging heat treatment temperature increases, the hardness of the austenite phase is substantially constant at 245 to 250 MPa.

(e) From the findings described above, the following matters are estimated. In the case where aging heat treatment is performed on the duplex stainless having the above-mentioned chemical composition, if the aging heat treatment temperature is excessively low, the ferrite rate in the steel is high. In this case, the amount of Cu that precipitates in the ferrite per unit area is small. Hence, the ferrite hardness of the duplex stainless steel is excessively low (see FIG. 2), and the yield strength of the duplex stainless steel decreases (see FIG. 1A). Meanwhile, the aging heat treatment temperature is excessively high, the ferrite rate in the steel is low, and Cu in the ferrite dissolves. Hence, the ferrite hardness decreases (see FIG. 2). As a result, the yield strength of the duplex stainless steel decreases (see FIG. 1A). Moreover, if the aging heat treatment temperature is excessively high, a σ phase, Mo carbides, and Cr carbides are produced in the steel, and the toughness of the duplex stainless steel decreases (see FIG. 1B).

(f) If the aging heat treatment temperature is 460 to 630° C., the ferrite rate in the steel is 30 to 70%, and a sufficient amount of fine Cu precipitates in the ferrite. Hence, as shown in FIG. 2, the ferrite hardness is equal to or more than 300 $Hv_{10gf}$. As a result, as shown in FIG. 1A, the strength of the duplex stainless is equal to or more than 550 MPa. Moreover, if the aging heat treatment temperature falls within the above-mentioned temperature range, a σ phase, Mo carbides, and Cr carbides can be suppressed from being produced. Hence, as shown in FIG. 1B, the absorbed energy vE0 of the duplex stainless is equal to or more than 100 J.

(g) In the duplex stainless steel according to the present invention, the Mo content is set to be low. Moreover, W is not contained. That is, in the present invention, W is an impurity. If aging heat treatment is performed, Mo and W are more likely to form intermetallic compounds such as a σ phase and carbides in the steel. The σ phase and the carbides of Mo and W decrease the toughness of the steel. Accordingly, in the present invention, the Mo content is suppressed to be low, and W is an impurity.

On the basis of the above findings, the duplex stainless steel according to the present invention is completed. Hereinafter, the duplex stainless steel according to the present invention is described.

[Chemical Composition]

The duplex stainless steel according to the present invention has the following chemical composition.

C: 0.030% or less

Carbon (C) stabilizes austenite. Meanwhile, if C is excessively contained, carbides are more easily produced. In particular, Mo carbides decrease the toughness of the steel. Accordingly, the C content is equal to or less than 0.030%. Moreover, the upper limit of the C content is preferably 0.020%, and the C content is more preferably less than 0.020%.

Si: 0.20 to 1.00%

Silicon (Si) suppresses a decrease in the flowability of molten metal at the time of welding, and suppresses the occurrence of a weld defect. Meanwhile, if Si is excessively contained, an intermetallic compound typified by the a phase is more easily produced. Accordingly, the Si content is 0.20 to 1.00%. Moreover, the upper limit of the Si content is preferably 0.80% and more preferably 0.65%. Moreover, the lower limit of the Si content is preferably 0.30% and more preferably 0.35%.

Mn: 8.00% or less

Manganese (Mn) desulfurizes and deoxidizes the steel, and increases the hot workability of the steel. Moreover, Mn increases the solubility of nitrogen (N). Meanwhile, if Mn is excessively contained, the corrosion resistance decreases. Accordingly, the Mn content is equal to or less than 8.00%. Moreover, the upper limit of the Mn content is preferably 7.50% and more preferably 5.00%. The lower limit of the Mn content is preferably 0.03% and more preferably 0.05%.

P: 0.040% or less

Phosphorus (P) is an impurity. P decreases the corrosion resistance and toughness of the steel. Accordingly, it is preferable that the P content be low. The P content is equal to or less than 0.040%. The P content is preferably equal to or less than 0.030% and more preferably equal to or less than 0.020%.

S: 0.0100% or less

Sulfur (S) is an impurity. S decreases the hot workability of the steel. Moreover, S forms sulfides. The sulfides become pitting occurrence origins, and thus decrease the pitting resistance of the steel. Accordingly, it is preferable that the S content be low. The S content is equal to or less than 0.0100%. The S content is preferably equal to or less than 0.0050% and more preferably equal to or less than 0.0010%.

Cu: more than 2.00% and 4.00% or less

Copper (Cu) strengthens a passivation film, and increases the corrosion resistance including the SCC resistance. Moreover, Cu finely precipitates in ferrite at the time of aging heat treatment. The precipitated Cu increases the hardness of the ferrite, and increases the strength of the steel. Moreover, Cu extremely finely precipitates in a base material at the time of high heat input welding, and suppresses the precipitation of the a phase at the ferrite/austenite phase boundary. Meanwhile, if Cu is excessively contained, the hot workability of the steel decreases. Accordingly, the Cu content is more than 2.00% and equal to or less than 4.00%. Moreover, the lower limit of the Cu content is preferably 2.20% and more preferably 2.40%.

Ni: 4.00 to 8.00%

Nickel (Ni) stabilizes austenite. Moreover, Ni increases the toughness of the steel, and increases the corrosion resistance including the SCC resistance of the steel. Meanwhile, if Ni is excessively contained, an intermetallic compound typified by the a phase is more easily produced. Accordingly, the Ni content is 4.00 to 8.00%. The lower limit of the Ni content is preferably 4.20% and more preferably 4.50%. The upper limit of the Ni content is preferably 7.50% and more preferably 7.00%.

Cr: 20.0 to 30.0%

Chromium (Cr) increases the corrosion resistance of the steel. In particular, Cr increases the SCC resistance of the steel. Meanwhile, if Cr is excessively contained, an intermetallic compound typified by the σ phase is produced, and Cr carbides are also produced. The σ phase and the Cr carbides decrease the toughness of the steel, and also decrease the hot workability. Accordingly, the Cr content is 20.0 to 30.0%. The lower limit of the Cr content is preferably 22.0% and more preferably 24.0%. Moreover, the upper limit of the Cr content is preferably 28.0% and more preferably 27.0%.

Mo: 0.50% or more and less than 2.00%

Molybdenum (Mo) increases the SCC resistance of the steel. Meanwhile, if Mo is excessively contained, an intermetallic compound typified by the σ phase is produced. The σ phase decreases the toughness, weldability, and hot workability of the steel. If Mo is excessively contained, moreover, Mo carbides are produced. The Mo carbides decrease the toughness of the steel. Accordingly, the Mo content is equal to or more than 0.50% and less than 2.00%. The lower limit of the Mo content is preferably 0.80% and more preferably 1.00%.

N: 0.100 to 0.350%

Nitrogen (N) is a strong austenite forming element, and increases the thermal stability and corrosion resistance of the steel. The duplex stainless steel according to the present invention contains Cr and Mo that are ferrite forming elements. If the balance of the amount of ferrite and the amount of austenite in the duplex stainless steel is taken into consideration, the N content is equal to or more than 0.100%. Meanwhile, if N is excessively contained, blow holes that are weld defects occur. If N is excessively contained, moreover, nitrides are more easily produced at the time of welding, and the toughness and corrosion resistance of the steel decrease. Accordingly, the N content is 0.100 to 0.350%. The lower limit of the N content is preferably 0.120% and more preferably 0.150%.

Sol. Al: 0.040% or less

Aluminum (Al) deoxidizes the steel. Meanwhile, if Al is excessively contained, aluminum nitride (AlN) is formed, and the toughness and corrosion resistance of the steel decrease. Accordingly, the Al content is equal to or less than 0.040%. The Al content herein means the content of acid-soluble Al (sol. Al). In the present invention, Al is an essential element.

The lower limit of the Al content is preferably 0.003% and more preferably 0.005%. The upper limit of the Al content is preferably 0.035% and more preferably 0.030%.

The balance of the duplex stainless steel according to the present invention consists of Fe and impurities. The impurities in this context mean elements mixed in for ores and scraps used as raw materials for the steel or various factors in a production process. Note that, in the present invention, W is an impurity. In the case of performing aging heat treatment, W promotes the production of the σ phase. Moreover, W forms carbides. The σ phase and the W carbides decrease the toughness of the steel. Hence, in the present invention, W is an impurity, and the W content is equal to or less than 0.1%.

[With Regard to Selective Element]

The chemical composition of the duplex stainless steel according to the present invention may contain, instead of Fe, one or more types of element selected from at least one group of the following first group to third group. That is, the elements in the first group to the third group are selective elements that can be contained as needed.

First group: V: 1.50% or less

Second group: Ca: 0.0200% or less, Mg: 0.02% or less, and B: 0.0200% or less

Third group: rare earth metal (REM): 0.2000% or less

Hereinafter, these selective elements are described in detail.

[First Group]

V: 1.50% or less

Vanadium (V) is a selective element. V increases the corrosion resistance of the duplex stainless steel, and particularly increases the corrosion resistance under acid environments. More specifically, if V is contained together with Mo and Cu, the crevice corrosion resistance of the steel increases. Meanwhile, if V is excessively contained, the amount of ferrite in the steel excessively increases, and the corrosion resistance of the steel decreases. Accordingly, the V content is equal to or less than 1.50%, and is preferably less than 1.50%. If the V content is equal to or more than 0.05%, the above-mentioned effect can be remarkably obtained. However, even if the V content is less than 0.05%, the above-mentioned effect can be obtained to some extent. Moreover, the upper limit of the V content is preferably 0.50% and more preferably 0.10%.

[Second Group]

Ca: 0.0200% or less

Mg: 0.02% or less

B: 0.0200% or less

Calcium (Ca), magnesium (Mg), and boron (B) are selective elements. Ca, Mg, and B immobilize S and O (oxygen) in the steel, and increase the hot workability of the steel. The S content of the duplex stainless steel according to the present invention is low. Accordingly, even if Ca, Mg, and B are not contained, the hot workability of the steel is high. However, for example, in the case where a seamless steel pipe is produced according to a skew rolling method, a higher hot workability may be required. If one or more types selected from the group consisting of Ca, Mg, and B are contained, a higher hot workability can be obtained.

Meanwhile, if one or more types of Ca, Mg, and V are excessively contained, non-metallic inclusions (such as oxides and sulfides of Ca, Mg, and B) increase. The non-metallic inclusions become pitting origins, and thus decrease the corrosion resistance of the steel. Accordingly, the Ca content is equal to or less than 0.0200%, the Mg content is equal to or less than 0.02%, and the B content is equal to or less than 0.02000.

In order to remarkably obtain the above-mentioned effect, it is preferable that the content of at least one type of Ca, Mg, and B or the total content of two or more types thereof be equal to or more than S (mass percent)+1/2×O (mass percent). However, if at least one type of Ca, Mg, and B or two or more types thereof are contained even a little, the above-mentioned effect can be obtained to some extent.

In the case where two types of Ca, Mg, and B are contained, the total content of these elements is equal to or less than 0.040. In the case where all of Ca, Mg, and B are contained, the total content of these elements is equal to or less than 0.06%.

[Third Group]

Rare earth metal (REM): 0.2000% or less

Rare earth metal (REM) is a selective element. Similarly to Ca, Mg, and B, REM immobilizes S and O (oxygen) in the steel, and increases the hot workability of the steel. Meanwhile, if REM is excessively contained, non-metallic inclusions (such as oxides and sulfides of rare earth metal) increase, and the corrosion resistance of the steel decreases. Accordingly, the REM content is equal to or less than 0.2000%. In order to remarkably obtain the above-mentioned effect, it is preferable that the REM content be equal to or more than S (mass percent)+1/2×O (mass percent). However, if REM is contained even a little, the above-mentioned effect can be obtained to some extent.

REM is a collective term including 15 elements of lanthanoid, Y, and Sc. One or more types of these elements are contained. The REM content means the total content of one or more types of these elements.

[Structure]

The structure of the duplex stainless steel according to the present invention includes ferrite and austenite, and the balance thereof consists of precipitates and inclusions.

In the structure of the duplex stainless steel according to the present invention, the ferrite rate is 30 to 70%. Note that the ferrite rate refers to the ferrite area fraction, and is measured according to the following method. A sample is collected from a given portion of the duplex stainless steel.

The collected sample is mechanically polished, and then the polished sample is electrolytically etched in a 30%-KOH solution. The etched sample surface is observed using an optical microscope. At this time, the ferrite rate is measured according to a point counting method in conformity to ASTM E562.

Moreover, the hardness of the ferrite is equal to or more than 300 $Hv_{10gf}$. Here, the hardness of the ferrite is determined according to the following method. Given ten points are selected from the ferrite in the sample used for structure observation described above. The Vickers hardness in conformity to JIS 22244 is measured at the selected ten points. The test power at the time of the measurement is set to 98.07 N (the hardness symbol is "$Hv_{10gf}$"). The average of eight points obtained by excluding the maximum value and the minimum value from the measured Vickers hardness values is defined as the hardness of the ferrite.

In the case where the ferrite rate is less than 30%, the duplex stainless steel cannot be provided with a sufficient yield strength. Specifically, the yield strength of the duplex stainless steel is less than 550 MPa. Meanwhile, in the case where the ferrite rate is more than 70%, the toughness of the duplex stainless steel is excessively low. Hence, the upper limit of the ferrite rate is 70%.

Moreover, even if the ferrite rate falls within a range of 30 to 70%, if Cu does not sufficiently precipitate in the ferrite, the duplex stainless steel cannot be provided with a sufficient yield strength. Specifically, even if the ferrite rate is 30 to 70%, if the ferrite hardness is less than 300 $Hv_{10gf}$, the yield strength of the duplex stainless steel is less than 550 MPa.

If the ferrite rate is 30 to 70% and if the ferrite hardness is equal to or more than 300 $HV_{10gf}$, a sufficient amount of Cu precipitates in the ferrite. Hence, the duplex stainless steel has an excellent strength. Moreover, if the ferrite rate is 30 to 70%, the duplex stainless steel has an excellent toughness. In the case where the ferrite rate is 30 to 70% and where the ferrite hardness is equal to or more than 300 $Hv_{10gf}$, the yield strength of the duplex stainless steel is equal to or more than 550 MPa, and the absorbed energy vE0 is equal to or more than 100 J.

The ferrite hardness is preferably equal to or more than 315 $Hv_{10gf}$. In this case, the yield strength of the duplex stainless steel is equal to or more than 580 MPa.

[Production Method]

The duplex stainless steel having the above-mentioned chemical composition is molten. The duplex stainless steel may be molten using an electric furnace, and may be molten using an Ar—$O_2$ gaseous mixture bottom blowing decarburization furnace (AOD furnace). Alternatively, the duplex stainless steel may be molten using a vacuum decarburization furnace (VOD furnace). The molten duplex stainless steel may be formed into an ingot according to an ingot-making process, and may be formed into a cast piece (a slab, a bloom, or a billet) according to a continuous casting process.

A duplex stainless steel material is produced using the produced ingot or cast piece. Examples of the duplex stainless steel material include a duplex stainless steel plate and a duplex stainless steel pipe.

The duplex stainless steel plate is produced according to, for example, the following method. Hot working is performed on the produced ingot or slab, whereby the duplex stainless steel plate is produced. Examples of the hot working include hot forging and hot rolling.

The duplex stainless steel pipe is produced according to, for example, the following method. Hot working is performed on the produced ingot, slab, or bloom, whereby a billet is produced. Hot working is performed on the produced billet, whereby the duplex stainless steel pipe is produced. Examples of the hot working include piercing-rolling according to a Mannesmann process. Hot extrusion may be performed as the hot working, and hot forging may be performed thereas. The produced duplex stainless steel pipe may be a seamless pipe, and may be a welded steel pipe.

In the case where the duplex stainless steel pipe is a welded steel pipe, for example, bending work is performed on the above-mentioned duplex stainless steel pipe, to be thereby formed into an open pipe. Both end faces in the longitudinal direction of the open pipe are welded according to a well-known welding method such as submerged arc welding, whereby the welded steel pipe is produced.

Solution treatment is performed on the produced duplex stainless steel material. Specifically, the duplex stainless steel material is put in a heat treatment furnace, and is soaked at a solution treatment temperature of 980 to 1,200° C. After the soaking, the duplex stainless steel is rapidly cooled by water-cooling or the like. The soaking time in the solution treatment is preferably 2 to 60 minutes.

After the solution treatment, aging heat treatment is performed on the duplex stainless steel material. Specifically, the duplex stainless steel material is put in a heat treatment furnace. Then, the duplex stainless steel material is soaked at an aging heat treatment temperature of 460 to 630° C. After the soaking, the duplex stainless steel is air-cooled. The soaking time in the aging heat treatment is preferably 2 to 60 minutes.

If the solution heat treatment and the aging heat treatment are performed under the above-mentioned conditions, the ferrite rate of the duplex stainless steel is adjusted to be 30 to 70%. Moreover, the ferrite hardness is equal to or more than 300 $Hv_{10gf}$. As a result, the duplex stainless steel can be provided with an excellent yield strength and toughness.

The solution treatment temperature is preferably 1,050 to 1,150° C., and the aging heat treatment temperature is preferably 480 to 600° C. In this case, the ferrite rate is 35 to 55%, and the ferrite hardness is equal to or more than 315 $Hv_{10gf}$. As a result, the yield strength of the duplex stainless steel is equal to or more than 580 MPa. The aging heat treatment temperature is more preferably more than 480° C. and equal to or less than 600° C. and still more preferably 500 to 600° C.

EXAMPLE

Duplex stainless steels having various chemical compositions were molten using a vacuum furnace having a capacity of 150 kg. A plurality of duplex stainless steel plates were produced using the molten duplex stainless steels according to various production conditions. The yield strength and toughness of the produced steel plates are examined.

[Examination Method]

Duplex stainless steels having chemical compositions of the steel A to steel F and steel X to steel Z shown in Table 1 were molten.

TABLE 1

| Steel | Chemical Composition (in mass percent, the balance: Fe and impurities) | | | | | | | | | | | | | | | |
|---|---|---|---|---|---|---|---|---|---|---|---|---|---|---|---|---|
| | C | Si | Mn | P | S | Cu | Ni | Cr | Mo | N | sol. Al | V | Ca | Mg | B | REM |
| A | 0.014 | 0.52 | 0.97 | 0.021 | 0.0002 | 2.44 | 5.03 | 25.0 | 1.10 | 0.189 | 0.014 | 0.05 | 0.0023 | | 0.0023 | — |
| B | 0.015 | 0.50 | 1.51 | 0.001 | 0.0008 | 3.41 | 4.21 | 20.3 | 1.98 | 0.152 | 0.020 | — | — | — | — | — |
| C | 0.015 | 0.50 | 1.52 | 0.014 | 0.0011 | 2.20 | 4.08 | 23.9 | 1.96 | 0.192 | 0.020 | 0.06 | 0.0015 | — | — | — |
| D | 0.017 | 0.51 | 1.53 | 0.012 | 0.0004 | 2.51 | 7.82 | 25.2 | 1.02 | 0.305 | 0.013 | — | — | 0.02 | — | — |
| E | 0.015 | 0.50 | 1.03 | 0.014 | 0.0006 | 2.07 | 5.22 | 26.0 | 0.51 | 0.228 | 0.014 | — | — | — | — | 0.0012 |
| F | 0.016 | 0.50 | 1.03 | 0.015 | 0.0009 | 2.15 | 5.22 | 27.1 | 0.50 | 0.202 | 0.014 | 0.08 | — | — | 0.0006 | — |
| X | 0.016 | 0.49 | 1.52 | 0.011 | 0.0008 | 3.22 | 5.21 | 18.1 | 1.94 | 0.232 | 0.012 | — | — | — | — | — |
| Y | 0.011 | 0.48 | 1.54 | 0.012 | 0.0009 | 1.55 | 5.12 | 26.7 | 1.04 | 0.155 | 0.020 | — | — | — | — | — |
| Z | 0.015 | 0.49 | 1.03 | 0.016 | 0.0006 | 1.21 | 5.08 | 24.8 | 2.11 | 0.185 | 0.020 | — | — | — | — | — |

The contents (mass percents) of elements in each of the steel A to the steel F and the steel X to the steel Z are shown in the chemical composition section in Table 1. The balance (components other than the elements shown in Table 1) in the chemical composition with each steel type number consists of Fe and impurities. "-" in Table 1 represents that the content of the corresponding element is in an impurity level.

The chemical compositions of the steel A to the steel F fell within the range of the chemical composition of the present invention. Meanwhile, the chemical compositions of the steel X to the steel Z fell outside of the range of the chemical composition of the present invention. Specifically, the Cr content of the steel X was less than the lower limit of the Cr content according to the present invention. The Cu content of the steel Y was less than the lower limit of the Cu content according to the present invention. The Cu content of the steel Z was less than the lower limit of the Cu content according to the present invention. Then, the Mo content of the steel Z was more than the upper limit of the Mo content according to the present invention.

The molten duplex stainless steels were cast, whereby ingots were produced. The produced ingots were each heated to 1,250° C. Hot forging was performed on the heated ingots, whereby plate materials were produced. The produced plate materials were heated again to 1,250° C. Hot rolling was performed on the heated plate materials, whereby a plurality of steel plates each having a thickness of 15 mm were produced. The surface temperature of each steel material at the time of the rolling was 1,050° C.

Solution treatment and aging heat treatment were performed on the plurality of produced steel plates, whereby steel plates with test numbers 1 to 15 in Table 2 were produced.

Solution treatment was performed on the steel plate with each test number. The solution treatment temperature (° C.) was as shown in Table 2, and the soaking time was 5 minutes for all the test numbers. More specifically, each steel plate was put in a heat treatment furnace, and then was held for 5 minutes at the solution treatment temperature (° C.) shown in Table 2. After that, each steel plate was taken out of the heat treatment, and was water-cooled until the surface temperature of the steel plate reached a normal temperature (25° C.)

After the solution treatment, aging heat treatment was performed on each steel plate. The aging heat treatment temperature (° C.) was as shown in Table 2, and the soaking time was 30 minutes for all the test numbers. More specifically, each steel plate was put in a heat treatment furnace, and then was held for 30 minutes at the aging heat treatment temperature (° C.) shown in Table 2. After that, each steel plate was taken out of the heat treatment furnace, and was air-cooled until the surface temperature of the steel plate reached a normal temperature (25° C.)

[Measurement of Ferrite Rate]

The ferrite rate of the steel plate with each test number was obtained according to the following method. A specimen for structure observation was collected from each steel plate. The collected specimen was mechanically polished, and the polished specimen was electrolytically etched in a 30-KOH solution. The etched sample surface was observed using an optical microscope (with ×400 field). At this time, the area of the observed region was about 2,000 $\mu m^2$. The ferrite rate (%) in the observed region was obtained. The ferrite rate was obtained according to a point counting method in conformity to ASTM E562.

TABLE 2

| Test Number | Steel | Solution Treatment Temperature (° C.) | Aging Heat Treatment Temperature (° C.) | Ferrite Rate (%) | Ferrite Hardness ($Hv_{10gf}$) | YS (MPa) | TS (MPa) | vE0 (J) |
|---|---|---|---|---|---|---|---|---|
| 1 | A | 1070 | 500 | 54 | 332 | 612 | 846 | 174 |
| 2 | A | 1070 | 550 | 43 | 329 | 631 | 859 | 163 |
| 3 | A | 1070 | 600 | 37 | 317 | 588 | 807 | 158 |
| 4 | B | 1070 | 550 | 41 | 335 | 613 | 842 | 117 |
| 5 | C | 1070 | 550 | 44 | 308 | 578 | 853 | 121 |
| 6 | D | 1070 | 550 | 36 | 315 | 580 | 802 | 180 |
| 7 | E | 1070 | 550 | 43 | 317 | 606 | 839 | 184 |
| 8 | F | 1070 | 550 | 55 | 327 | 622 | 837 | 167 |
| 9 | A | 1070 | 450 | 62 | 298 | 545 | 850 | 207 |
| 10 | A | 1070 | 700 | 33 | 291 | 502 | 772 | 65 |
| 11 | X | 1070 | 550 | 29 | 305 | 543 | 793 | 182 |
| 12 | Y | 1070 | 550 | 45 | 278 | 540 | 801 | 179 |
| 13 | Z | 1070 | 550 | 47 | 284 | 537 | 776 | 85 |
| 14 | A | 1070 | — | 49 | 283 | 528 | 796 | 210 |
| 15 | D | 1070 | 700 | 29 | 289 | 500 | 762 | 62 |

[Ferrite Hardness Measurement Test]

The ferrite hardness of the steel plate with each test number was determined according to the following method. Given ten points were selected from the ferrite in the observed region of the specimen for structure observation described above. The Vickers hardness in conformity to JIS 22244 was measured at each of the selected points. The test power at the time of the measurement was 98.07 N. The average of eight points obtained by excluding the maximum value and the minimum value from the measured Vickers hardness values is defined as the ferrite hardness ($Hv_{10gf}$.

[Yield Strength and Tensile Strength Test]

A round bar tensile specimen was collected from the steel plate with each test number. The round bar tensile specimen had an outer diameter of 6.35 mm and a parallel part length of 25.4 mm. The parallel part thereof extended in the rolling direction of the steel plate. A tensile test was performed on the collected round bar specimen at a normal temperature, whereby a yield strength YS (MPa) and a tensile strength TS (MPa) were obtained. An offset yield stress of 0.2% based on ASTM A370 was defined as the yield strength YS (MPa).

[Toughness Test]

A Charpy impact test was performed as the toughness test. For the Charpy impact test, a full-size V-notch specimen (having a width of 10 mm, a thickness of 10 mm, a length of 55 mm, and a notch depth of 2 mm) was collected from each steel plate. The Charpy impact test at 0° C. was performed using the collected V-notch specimen on the basis of JIS 22242, whereby the absorbed energy (vE0) was obtained.

[Examination Results]

The test results are shown in Table 2. The ferrite rate (%) for each test number is inputted to the "Ferrite Rate" section in Table 2. The ferrite hardness ($Hv_{10gf}$) for each test number is inputted to the "Ferrite Hardness" section. The yield strength (MPa) for each test number is inputted to the "YS" section. The tensile strength (MPa) for each test number is inputted to the "TS" section. The absorbed energy (J) at 0° C. for each test number is inputted to the "vE0" section.

With reference to Table 2, the chemical compositions of the steel plates with the test numbers 1 to 8 fell within the range of the present invention. Moreover, the solution treatment temperatures and the aging heat treatment temperatures of the steel plates with the test numbers 1 to 8 fell within the range of the present invention. Hence, the ferrite rates of the steel plates with the test numbers 1 to 8 fell within a range of 30 to 70%, and all the ferrite hardnesses thereof were equal to or more than 300 $Hv_{10gf}$. As a result, the yield strengths YS of the steel plates with the test numbers 1 to 8 were equal to or more than 550 MPa, and were more specifically equal to or more than 580 MPa. Moreover, the absorbed energies vE0 at 0° C. of the steel plates with the test numbers 1 to 8 were equal to or more than 100 J.

In comparison, although the chemical composition of the steel plate with the test number 9 fell within the range of the present invention, the aging heat treatment temperature was 450° C., which was less than the lower limit of the aging heat treatment temperature according to the present invention. Hence, the yield strength YS of the steel plate with the test number 9 was less than 550 MPa. This is presumably because, due to the excessively low aging heat treatment temperature, the amount of precipitated Cu was not enough to increase the strength of the entire ferrite.

Although the chemical composition of the steel plate with the test number 10 fell within the range of the present invention, the aging heat treatment temperature was 700° C., which was more than the upper limit of the present invention. Hence, the ferrite hardness of the steel plate with the test number 10 was less than 300 $Hv_{10gf}$, and the yield strength YS thereof was equal to or less than 550 MPa. This is presumably because, due to the excessively high aging heat treatment temperature, Cu dissolved in the ferrite, and the amount of precipitated Cu was thus small.

Moreover, the absorbed energy vE0 of the steel plate with the test number 10 was less than 100 J. This is presumably because, due to the excessively high aging heat treatment temperature, large amounts of a phases, Mo carbides, and Cr carbides precipitated.

The Cr content of the steel plate with the test number 11 was less than the lower limit of the Cr content according to the present invention. Hence, the ferrite rate was less than 30%, and the yield strength YS was less than 550 MPa. It is estimated that, due to the excessively low ferrite rate, the yield strength YS was low.

The Cu content of the steel plate with the test number 12 was less than the lower limit of the Cu content according to the present invention. Hence, the ferrite hardness was less than 300 $HV_{10gf}$, and the yield strength YS was less than 550 MPa. It is estimated that, due to the excessively low Cu content, the amount of Cu precipitated in the ferrite was low.

The Cu content of the steel plate with the test number 13 was less than the lower limit of the Cu content according to the present invention. Moreover, the Mo content of the steel plate with the test number 13 was more than the upper limit of the Mo content according to the present invention. Hence, the yield strength YS was less than 550 MPa, and the absorbed energy vE0 was less than 100 J. It is estimated that, due to the excessively low Cu content, the amount of precipitated Cu was small, and the yield strength YS was low. It is also estimated that, due to the excessively high Mo content, large amounts of a phases and Mo carbides precipitated, and the toughness was low.

The chemical composition of the steel plate with the test number 14 fell within the range of the present invention, and the solution treatment temperature thereof fell within the range of the present invention. However, the aging heat treatment was not performed on the steel plate with the test number 14. Hence, the ferrite hardness was less than 300 $Hv_{10gf}$, and the yield strength was less than 550 MPa.

Although the chemical composition of the steel plate with the test number 15 fell within the range of the present invention, the aging heat treatment temperature was 700° C., which was more than the upper limit of the present invention. Hence, the ferrite rate of the steel plate with the test number 15 was less than 30%, the ferrite hardness thereof was less than 300 $Hv_{10gf}$, and the yield strength thereof was less than 550 MPa. It is estimated that, due to the excessively high aging heat treatment temperature and the excessively low ferrite rate, target performance could not be achieved.

Hereinabove, the embodiment of the present invention has been described, and the above-mentioned embodiment is given as a mere example for carrying out the present invention. Accordingly, the present invention is not limited to the above-mentioned embodiment, and can be carried out by appropriately modifying the above-mentioned embodiment within a range not departing from the gist thereof.

INDUSTRIAL APPLICABILITY

A duplex stainless steel according to the present invention can be widely applied to fields that are required to have a high strength and a high toughness. In particular, a duplex stainless steel according to the present invention can be applied to a steel material for a line pipe.

The invention claimed is:

1. A production method for a duplex stainless steel material, comprising the steps of:

producing a hot worked product made of a duplex stainless steel material having a chemical composition containing, in mass percent, C: at most 0.030%, Si: 0.20 to 1.00%, Mn: at most 8.00%, P: at most 0.040%, S: at most 0.0100%, Cu: more than 2.00% and at most 4.00%, Ni: 4.00 to 8.00%, Cr: 20.0 to 30.0%, Mo: at least 0.50% and less than 2.00%, N: 0.100 to 0.350%, and sol. Al: at most 0.040%, the balance being Fe and impurities;

performing solution treatment on the produced hot worked product at 980 to 1,200° C.; and performing aging heat treatment on the hot worked product that has been subjected to the solution treatment, at a temperature of more than 480 and at most 600° C. for a soaking time of 2 to 30 minutes, wherein the hot worked product after the aging heat treatment has:

a structure, wherein a rate of ferrite in the structure is 43 to 55%, and a hardness of the ferrite in the structure is more than 315 $Hv_{10gf}$, a yield strength of 580MPa or more, and an absorbed energy vE0 obtained in a Charpy impact test at 0° C. with full-size V notch specimen specified in JIS Z2242 of 150 J or more.

2. A hot worked product made of a duplex stainless steel comprising:

a chemical composition containing, in mass percent, C: at most 0.030%, Si: 0.20to 1.00%, Mn: at most 8.00%, P: at most 0.040%, S: at most 0.0100%, Cu: more than 2.00% and at most 4.00%, Ni: 4.00 to 8.00%, Cr: 20.0 to 30.0%, Mo: at least 0.50% and less than 2.00%, N: 0.100 to 0.350%, and sol. Al: at most 0.040%, the balance being Fe and impurities; and a structure, wherein a rate of ferrite in the structure is 43 to 55%, and a hardness of the ferrite in the structure is more than 315 $Hv_{10gf}$, wherein the hot worked product has a yield strength of 580 MPa or more, and the hot worked product has an absorbed energy vE0 obtained in a Charpy impact test at 0° C. with full-size V notch specimen specified in JIS Z2242 of 150 J or more.

3. The hot worked product made of a duplex stainless steel according to claim 2, wherein the chemical composition further contains, in mass percent, V: at most 1.50%.

4. The hot worked product made of a duplex stainless steel according to claim 3, wherein the chemical composition further contains, in mass percent, at least one type selected from the group consisting of Ca: at most 0.0200%, Mg: at most 0.02%, and B: at most 0.0200%.

5. The hot worked product made of a duplex stainless steel according to claim 4, wherein the chemical composition further contains, in mass percent, rare earth metal: at most 0.2000%.

6. The hot worked product made of a duplex stainless steel according to claim 3, wherein the chemical composition further contains, in mass percent, rare earth metal: at most 0.2000%.

7. The hot worked product made of a duplex stainless steel according to claim 2, wherein the chemical composition further contains, in mass percent, at least one type selected from the group consisting of Ca: at most 0.0200%, Mg: at most 0.02%, and B: at most 0.0200%.

8. The hot worked product made of a duplex stainless steel according to claim 7, wherein the chemical composition further contains, in mass percent, rare earth metal: at most 0.2000%.

9. The hot worked product made of a duplex stainless steel according to claim 2, wherein the chemical composition further contains, in mass percent, rare earth metal: at most 0.2000%.

* * * * *